US010045629B2

(12) United States Patent
Urban

(10) Patent No.: US 10,045,629 B2
(45) Date of Patent: Aug. 14, 2018

(54) STACKABLE LEG

(71) Applicant: WOOD DESIGNS, Monroe, NC (US)

(72) Inventor: Ryan Gary Urban, Monroe, NC (US)

(73) Assignee: Wood Designs, Monroe, NC (US)

( * ) Notice: Subject to any disclaimer, the term of this patent is extended or adjusted under 35 U.S.C. 154(b) by 365 days.

(21) Appl. No.: 14/513,830

(22) Filed: Oct. 14, 2014

(65) Prior Publication Data

US 2016/0100693 A1 Apr. 14, 2016

(51) Int. Cl.
*A47C 19/20* (2006.01)
*A47D 7/00* (2006.01)

(52) U.S. Cl.
CPC ..... *A47C 19/202* (2013.01); *A47C 19/20* (2013.01); *A47D 7/00* (2013.01); *A47D 7/002* (2013.01)

(58) Field of Classification Search
CPC ..... A47C 19/00; A47C 19/20; A47C 19/202; A47C 17/64; A47D 7/00; A47D 7/002; B65D 2519/0094; B65D 2519/0096; A47B 87/0207
See application file for complete search history.

(56) References Cited

U.S. PATENT DOCUMENTS 1,408,114 A * 2/1922 Mathieu ..... A47C 3/04 108/91
2,699,814 A * 1/1955 Kahn ..... A47C 3/04 248/188.8
2,916,239 A * 12/1959 Stopps ..... B65D 19/0051 108/53.3
3,874,726 A * 4/1975 Sebel ..... A47C 3/04 297/239
4,958,390 A 9/1990 Mendenhall
5,044,691 A * 9/1991 Guichon ..... A47C 3/04 297/239
5,088,792 A * 2/1992 Guichon ..... A47C 3/04 297/239
D347,527 S * 6/1994 Breen ..... D6/336
D355,985 S * 3/1995 Karten ..... D6/374
D357,361 S * 4/1995 Karten ..... D6/349
D375,638 S * 11/1996 Dhanapal ..... D6/335
D375,854 S * 11/1996 Dhanapal ..... D23/304
5,641,034 A * 6/1997 Calmeise ..... A47C 12/00 182/17
6,701,548 B2 3/2004 Vigneron
7,086,100 B1 * 8/2006 Lo ..... A47D 7/002 5/110
D555,942 S * 11/2007 Adams ..... D21/397
8,176,857 B2 * 5/2012 Ochs ..... A47B 87/002 108/23
8,287,181 B1 * 10/2012 Melvin ..... E04D 15/00 248/146
8,333,430 B2 * 12/2012 Adams ..... A47C 7/462 297/181

(Continued)

*Primary Examiner* — Nicholas F Polito
*Assistant Examiner* — Ifeolu A Adeboyejo
(74) *Attorney, Agent, or Firm* — Seth L. Hudson; Clements Bernard Walker, PLLC

(57) ABSTRACT

The present invention provides methods and systems for a stackable leg that includes a foot, a flat flange extending generally upwardly from the foot, a first side flange and a second side flange extending generally upwardly from the foot and flanking the flat flange, wherein the first side flange and second side flange are disposed at an angle compared to the flat flange, and at least one cavity.

11 Claims, 7 Drawing Sheets

(56) References Cited

U.S. PATENT DOCUMENTS

| | | | | |
|---|---|---|---|---|
| 2003/0088914 | A1* | 5/2003 | Vigneron | A47C 19/202 5/8 |
| 2005/0166317 | A1* | 8/2005 | Kelly | A47C 7/282 5/110 |

* cited by examiner

STACKABLE LEG

FIELD OF THE INVENTION

The present invention relates generally to an improved leg that is intended to be engaged to like stackable elements for forming a stackable arrangement, allowing easy removal of one stackable element from subsequent stackable elements. More generally, the present invention relates to a stackable cot leg that allows the cots to be removed from each other easily, expeditiously, and without damaging the leg.

BACKGROUND OF THE INVENTION

Stackable elements, such as cots, usually are able to be stacked one-upon-the-other in the vertical direction for easy storage when space is at a premium. Generally, these stackable elements contain legs that are engaged to one another or in a nested arrangement for easy storage. The stackable elements are placed one-upon-the-other with their legs nested together.

When the stackable elements are removed from one another, damage to the legs often occur. The current design of these legs are illustrated in U.S. Pat. No. 6,701,548. The design of these legs requires the stackable element and all associated legs be lifted upwards in the vertical direction, at the same time, such that all legs are removed from the adjoining leg in the nested arrangement. Once all legs of the stackable element are not in the nested arrangement, the stackable element may be removed from the stack horizontally.

This removal of the stackable elements is easier said than done. Typically, the user removing the stackable element will pull towards them horizontally and vertically, especially when the stackable elements are placed high in the vertical direction. This pulling in the horizontal direction when one or more of the legs are still nested, results in damage to the leg. Additionally, pulling in the horizontal direction when at least one leg is still nested, creates a risk of all stackable elements within the stack being pulled in the horizontal direction, and potentially falling on the user. Therefore, there is a need for a leg of a stackable element that will not likely be damaged when the stackable element is pulled in both the vertical and horizontal direction.

BRIEF SUMMARY OF THE INVENTION

According to an embodiment of the present invention, a stackable leg that includes a foot, a flat flange extending generally upwardly from the foot, a first side flange and a second side flange extending generally upwardly from the foot and flanking the flat flange, wherein the first side flange and second side flange are disposed at an angle compared to the flat flange, and at least one cavity.

According to another embodiment of the present invention, the stackable leg is composed of plastic.

According to yet another embodiment of the present invention, the stackable leg includes a rim disposed on the upper edge of the flat flange, first side flange, and second side flange.

According to yet another embodiment of the present invention, the stackable leg includes two cavities that extend substantially perpendicularly to each other in the horizontal plane.

According to yet another embodiment of the present invention, the stackable leg includes a reception recess formed by the flat flange, first side flange, and second side flange.

According to yet another embodiment of the present invention, the stackable leg includes a retention element that extends from the first side flange to the second side flange.

According to yet another embodiment of the present invention, the stackable leg includes a generally square cavity.

According to yet another embodiment of the present invention, the stackable leg includes a foot, a flat flange extending generally upwardly from the foot with a bottom side, a top side, and two opposed sides. A first side flange and a second side flange extends generally upwardly from the foot having a bottom side, a top side, and two opposed sides, wherein the first side flange extends outwardly at an angle from one opposed side of the flat flange and the second side flange extends outwardly at an angle from the other opposed side of the flat flange. The stackable leg includes two cavities.

According to yet another embodiment of the present invention, the stackable leg includes a curved retention element that extends from the first side flange to the second side flange adjacent the foot.

According to yet another embodiment of the present invention, the stackable leg includes a rim extending along and extending outwardly from the top side of the flat flange, first side flange, and second side flange.

According to yet another embodiment of the present invention, the stackable leg includes a lip that extends between the cavities forming a top portion of the stackable leg.

According to yet another embodiment of the present invention, a cot assembly that includes two longitudinal elements each having two ends, two transverse elements each having two ends, and four stackable legs. The stackable legs include a foot, a flat flange extending generally upwardly from the foot, a first side flange and a second side flange extending generally upwardly from the foot and flanking the flat flange, wherein the first side flange and second side flange are disposed at an angle compared to the flat flange. A first cavity and a second cavity are disposed on the stackable leg, wherein the first cavity receives an end of the longitudinal element and the second cavity receives an end of the transverse element. A sheet is stretched across the longitudinal elements and transverse elements.

According to yet another embodiment of the present invention, the cot assembly includes a sheet having two longitudinal sides and two transverse sides, comprising a sheath on each longitudinal side and a sheath on each transverse side, whereby the sheaths on the longitudinal side receive the longitudinal elements and a sheath on the transverse side receive the transverse elements.

According to yet another embodiment of the present invention, the cot assembly includes longitudinal elements and transverse elements having a generally square cross-section and the cavities are generally square shaped.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
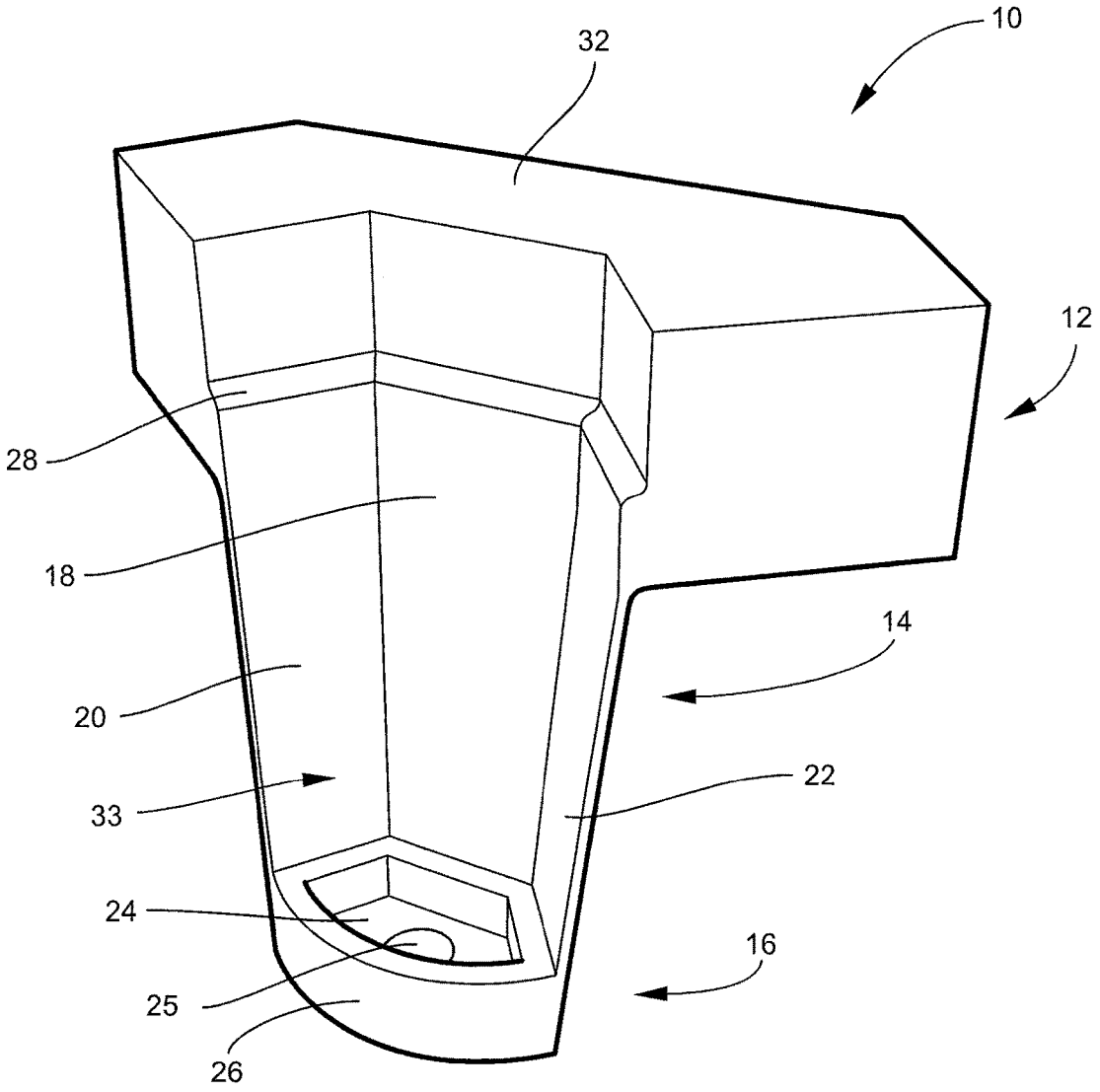
FIG. 1 is a front perspective view of the stackable leg.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring now specifically to the drawings, an improved leg for a stackable element is illustrated FIGS. 1-4 and is shown generally at reference numeral 10. The leg 10 includes an upper portion 12, a middle portion 14, and a lower portion 16. The middle portion 14 is open and contains angled sides that terminate into the lower portion 16. The middle portion contains a flat flange 18 that has a first side and a second side. A first side flange 20 and second side flange 22 extends outwardly at an angle from the first side and the second side of the flat flange 18. The flat flange 18, first side flange 20, and second side flange 22 terminate in a flat foot 24. A retention element 26 extends from an outer edge of the first side flange 20 to an outer edge of the second side flange 22. As illustration in FIG. 1, the retention element 26 is substantially curved and extends upwardly from an outer edge of the foot 24 to a height on the first side flange 20 and second side flange 22. The retention element 26 extends continuously along an interior surface of the first side flange 20, the interior surface of the second side flange 22, and the interior surface of the flat flange 18 and having a width greater than the width of the first side flange 20, second side flange 22, and flat flange 18 and forming a cavity within.

The middle portion 14 is open and not enclosed. In other words, the flat flange 18 is exposed externally and the first side flange 20 and second side flange 22 extend outwardly at an angle from opposite sides of the flat flange 18 and away from each other. The flat flange 18, first side flange 20, and second side flange 22 have an exterior side and an interior side, whereby the exterior side of the flat flange 18, first side flange 20, and second side flange 22 faces outward and are not covered or enclosed.

The flat flange 18, first side flange 20, and second side flange 22 extend upwardly to a rim 28 of the upper portion 12. The rim 28 extends along the top side of the first flange 18, first side flange 20, and second side flange 22. As illustrated, the rim 28 extends from the top side of the first side flange 20 to the top side of the second side flange 22.

Figure 2:
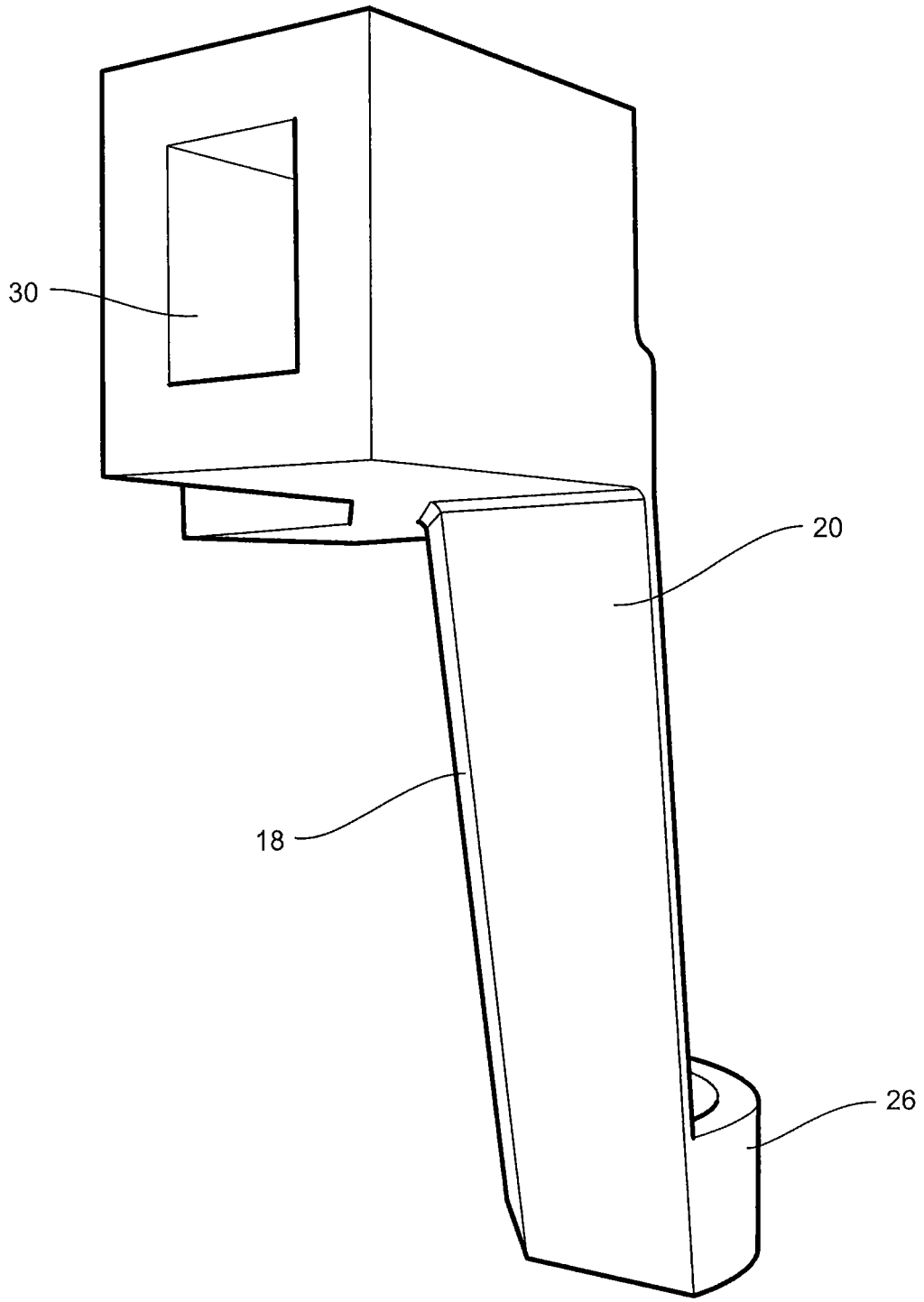
FIG. 2 is a side view of the stackable leg.
Figure 3:
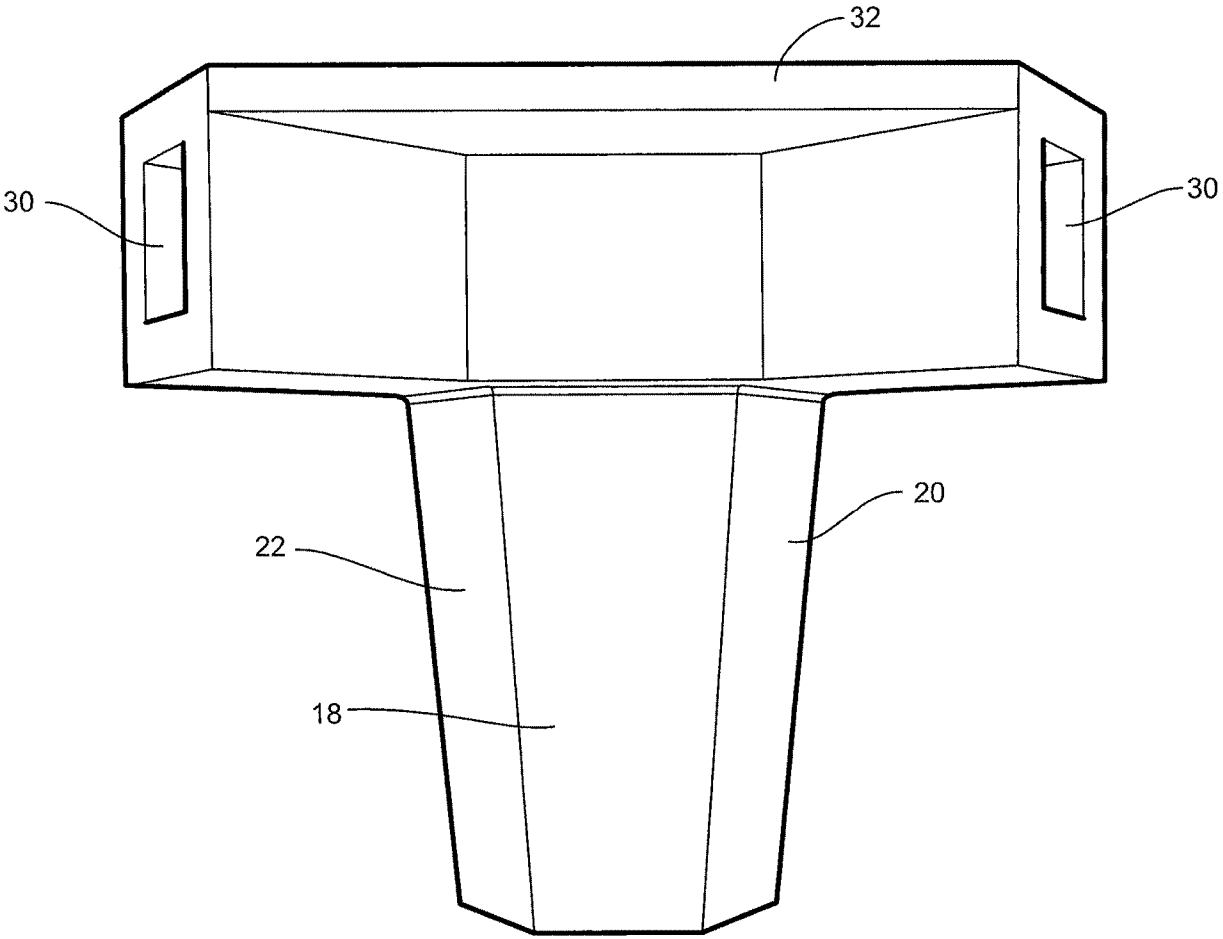
FIG. 3 is a back view of the stackable leg.

As illustrated in FIGS. 2-3, the upper portion 12 comprises two cavities 30 that extend outwardly in the horizontal direction from a height above the rim 28. The cavities 30 extend substantially perpendicularly to each other in the horizontal plane. As illustrated, the cavities are generally square, but any shape and sire desired by the user may be utilized. By way of example only and not meant to be limiting, the cavities 30 may be generally circular, rectangular and the like. A lip 32 extends in the horizontal plane between the upper exterior of the cavities 30.

The upper portion 12, middle portion 14, and lower portion 16, as illustrated, may be a single piece of plastic that is injection molded. Alternatively, the upper portion 12, middle portion 14, and lower portion 16 may be at least two individual or separate pieces that are connected together and assembled by the user. The stackable leg 10 may also be composed of wood, metal, or any other material as desired by the user.

Figure 4:
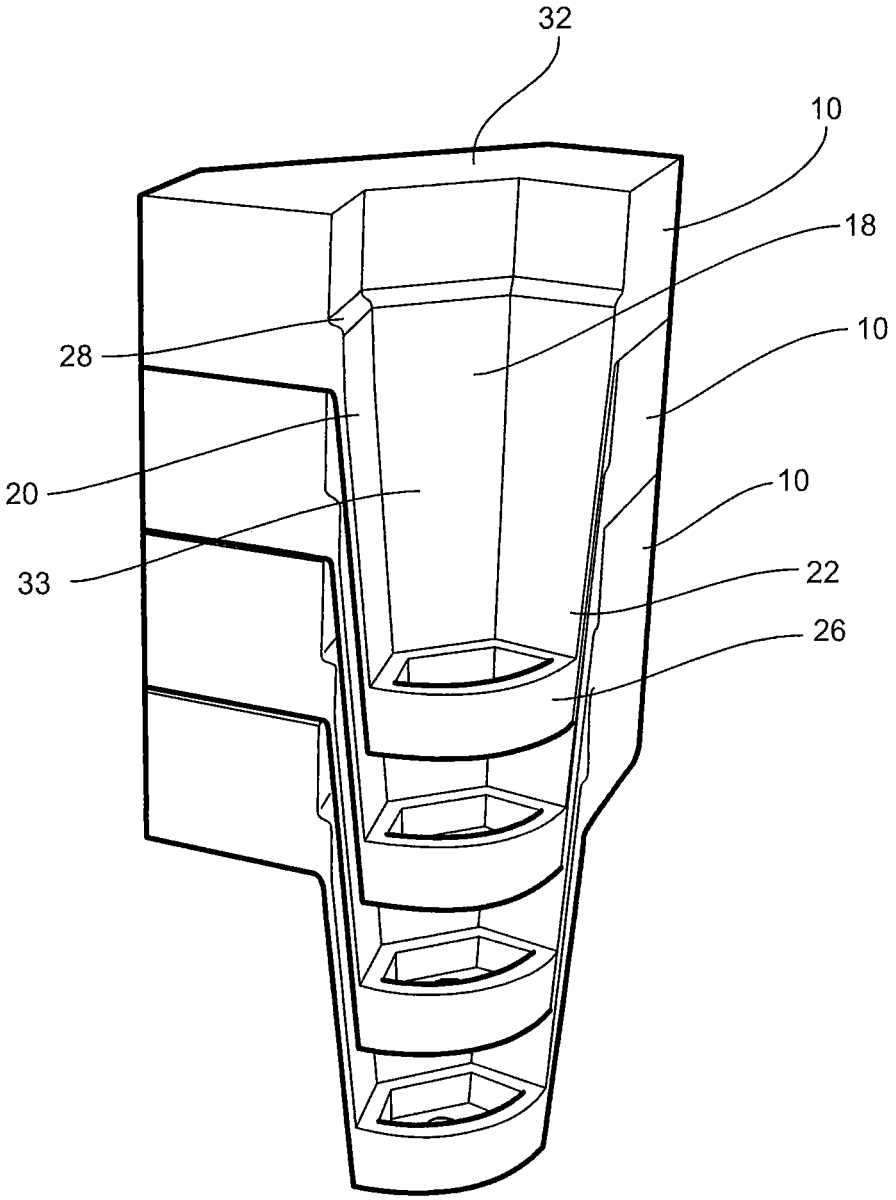
FIG. 4 is a perspective view of the stackable leg in the nested arrangement.

The flat flange 18, first side flange 20, and second side flange 22 collectively form a reception recess 33. The reception recess 33 consists substantially of the middle portion 14 of the stackable leg 10, and the flanges (18, 20, and 22) form the three sides of the reception recess 33. The width of the reception recess 33 is such that another stackable leg may be held laterally immobilized in the reception recess 33. The adjacent stackable leg, as illustrated in FIG. 4, slides within the reception recess 33, such that the first flanges are adjacent, the first side flange is adjacent, and the second side flange is adjacent.

As illustrated in FIG. 1, the foot 24 may contain a bore 25 that extends from the top side to the bottom side. The bottom side of the foot 24 may receive a bumper made of rubber or like material. Alternatively, the bumper may be engaged to the bore 25 on the foot 24 or a recess on the bottom side of the foot 24 may receive the bumper. When the bumper is attached to the foot 24, sliding on a tile, wood, or laminate floor is minimized. One side of the bumper may have an adhesive for engaging the adhesive side of the bumper to the boom side of the foot 24.

Figure 5:
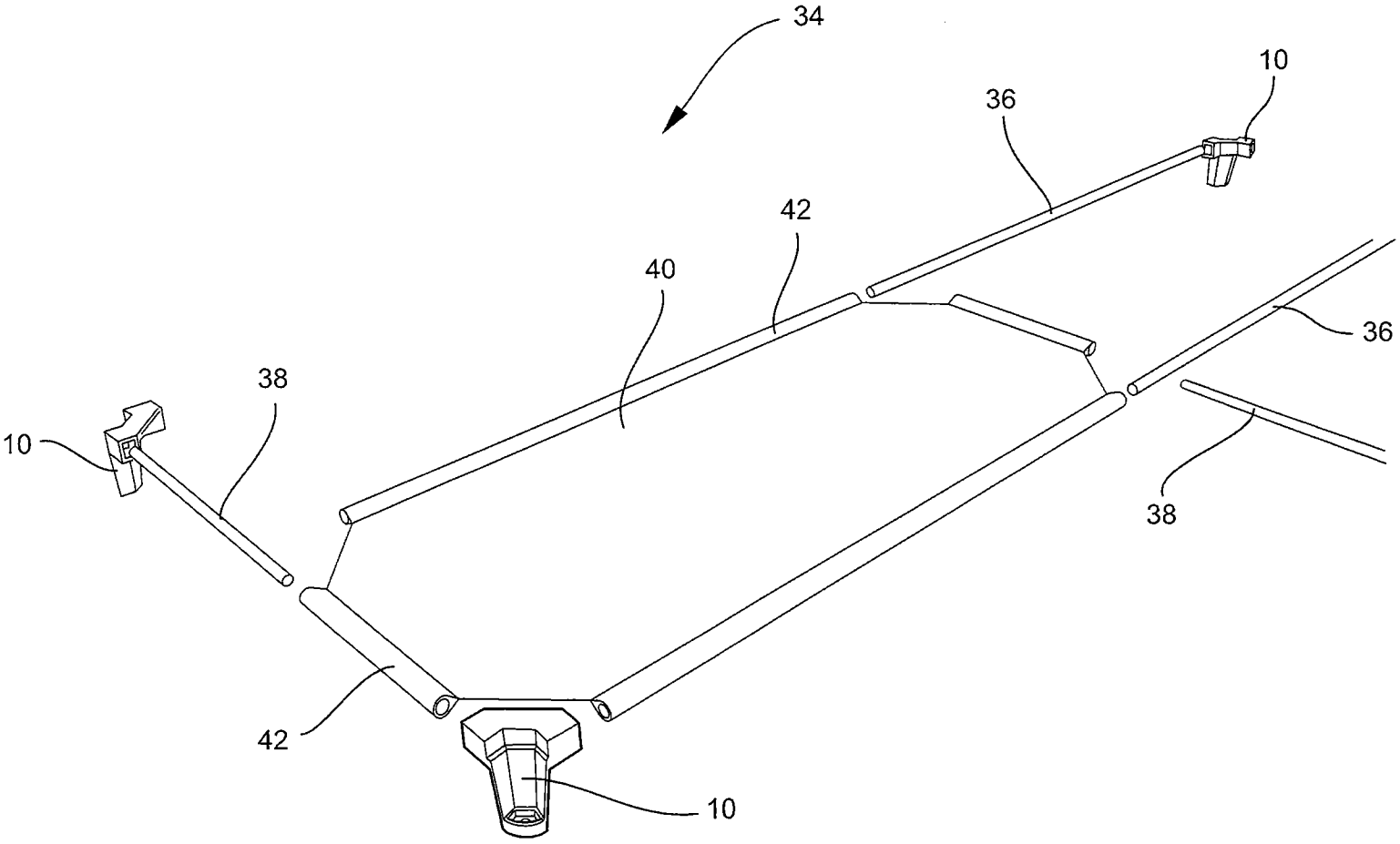
FIG. 5 is an exploded view of a cot containing stackable legs.
Figure 6:
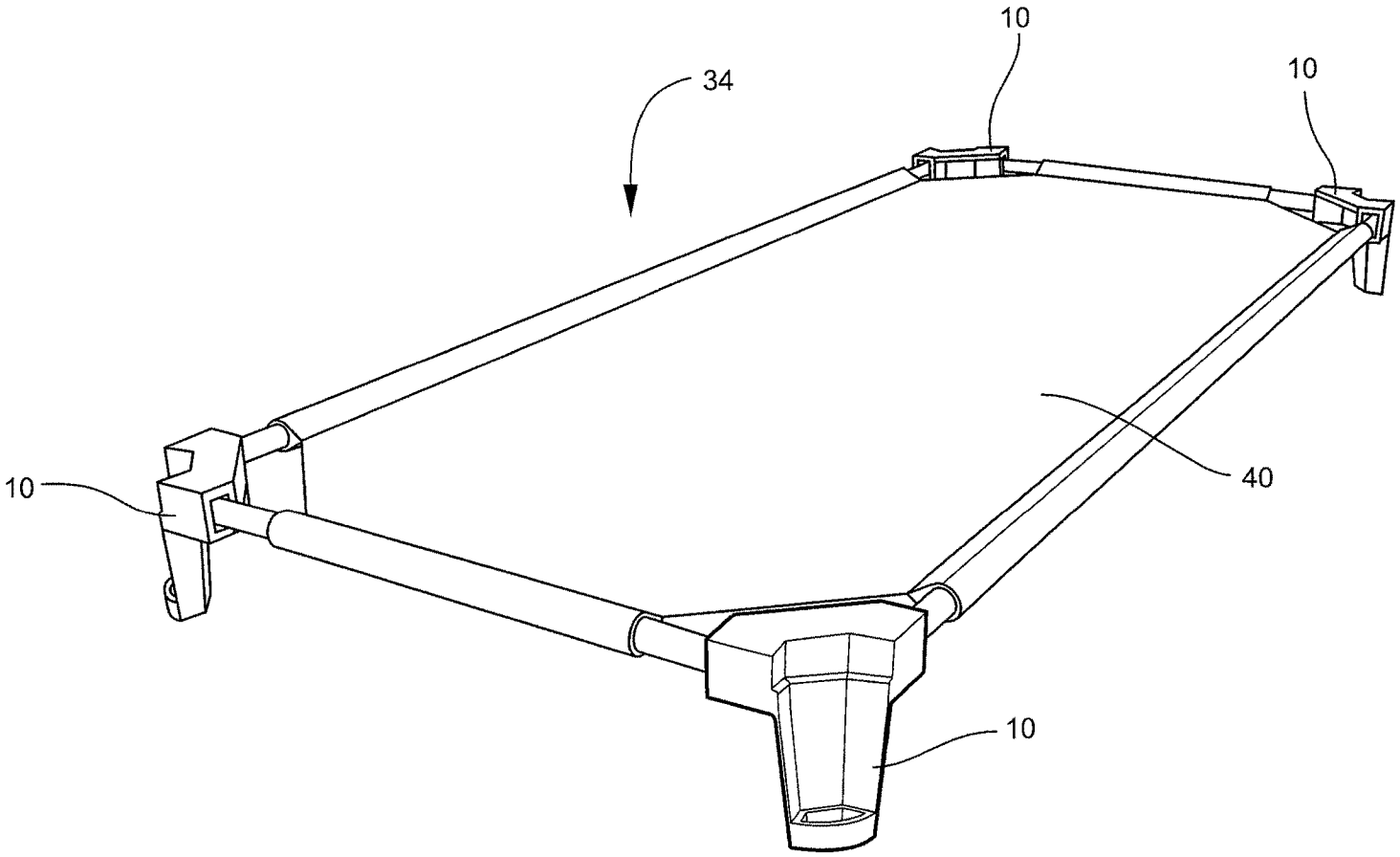
FIG. 6 is a perspective view of a cot with stackable legs.
Figure 7:
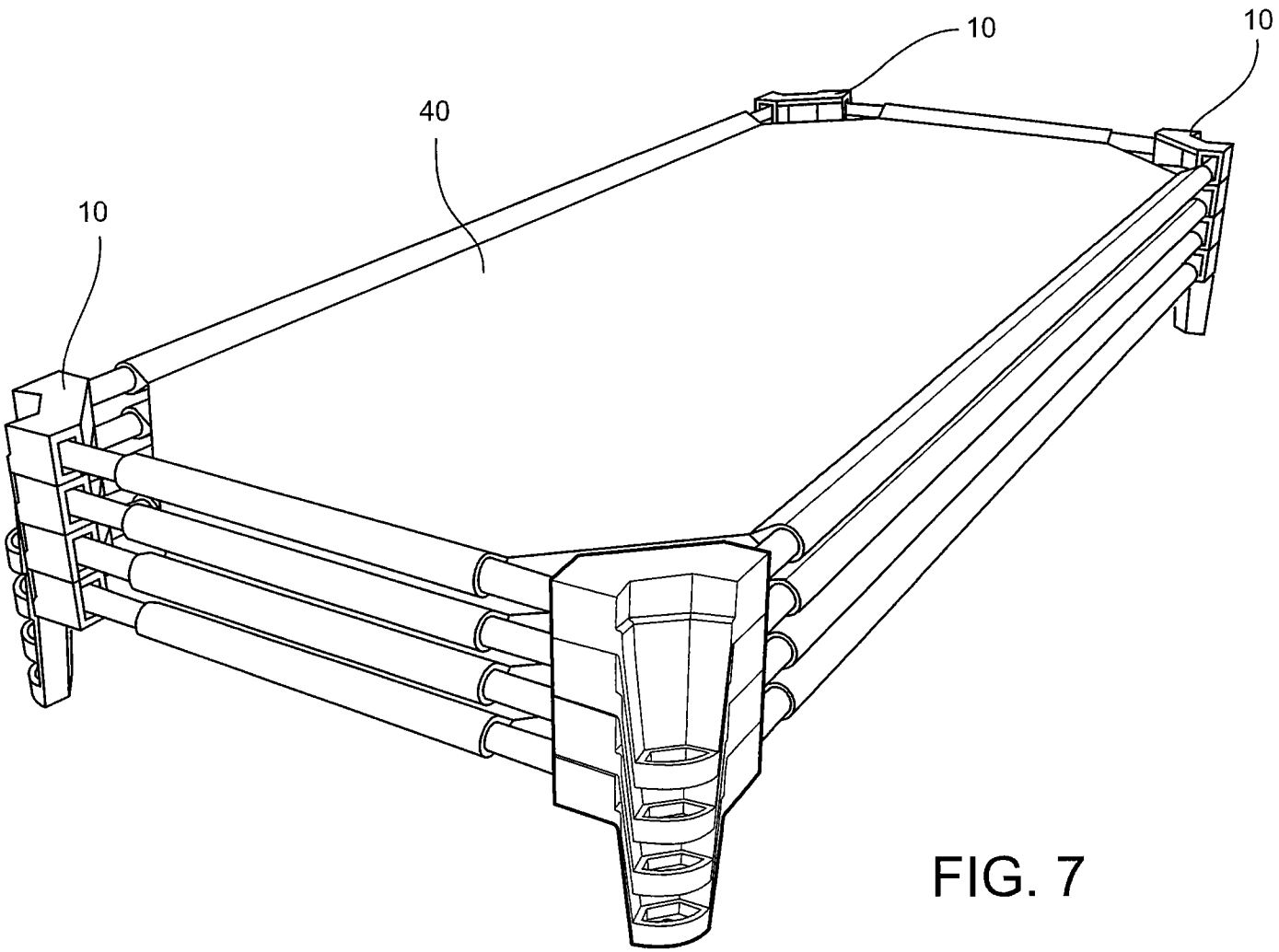
FIG. 7 is a perspective view of cots with stackable legs in a stacked arrangement.

The stackable leg 10 of the present invention may be incorporated into a cot assembly 34 as illustrated in FIGS. 5-7. The cot assembly 34 may consist of two elongated longitudinal elements 36 and two transverse elements 38. The longitudinal elements are engaged to the transverse elements by the stackable leg 10. A sheet 40 is stretched between the longitudinal elements 36 and transverse elements 38 to form the cot assembly 34. The cot assembly 34 consists of four stackable legs 10. Each longitudinal element 36 has two ends and each transverse element 38 has two ends. An end of a longitudinal element 36 is received within a cavity 30 of the stackable leg 10, and an end of the transverse element 38 is received within the other cavity 30 of the stackable leg 10. The cavity 30 receives and secures the longitudinal element 36 and transverse element 38.

The sheet 40 comprises two longitudinal sides and two transverse sides, including a sheath 42 on both longitudinal sides and a sheath 42 on both transverse sides. The sheath 42 is designed to receive and secure the longitudinal elements 36 and the transverse elements 38. The sheet 40 contains four corners that are recessed for allowing the placement of the stackable leg 10 between the longitudinal elements 36 and transverse elements 38.

As illustrated in FIG. 7, the cot assemblies 34 may be stacked one-upon-the-other, whereby the stackable legs 10 are in a nested arrangement. A cot assembly 34 is first placed on the ground or other flat, stable surface and then a second cot assembly 34 is placed on top of the first cot assembly 34. The stackable leg 10 of the second cot assembly 34 is placed within the reception recess 33 of the stackable leg 10 of the first cot assembly 34. In this arrangement, the exterior sides of the flat flange 18, first side flange 20, and second side flange 22 of the first cot assembly 34 are adjacent the interior sides of the flat flange 18, first side flange 20, and second side flange 22 of the second cot assembly 34

The stackable leg 10 of the present invention allows for the stacked cot assemblies 34 to be easily removed from the adjacent cot assembly 34 and reducing the risk of breaking or damaging the stackable leg 10. With the stackable leg 10 of the present invention, the top cot assembly 34 can be pulled in both the vertical and horizontal direction in removing the cot assembly 34 from the adjacent cot assembly 34. Because of the shape and design of the stackable leg 10, the stackable leg 10 does not securely engage the adjacent stackable leg 10, leading to broken or damaged legs like the prior art.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A stackable leg, comprising:

a foot having an outer edge;

a flat flange extending generally upwardly from the foot with a bottom side, a top side, and two opposed sides;

a first side flange and a second side flange extending generally upwardly from the foot having a bottom side, a top side, and two opposed sides, wherein the first side flange extends outwardly at an angle from one opposed side of the flat flange and the second side flange extends outwardly at an angle from the other opposed side of the flat flange;

a retention element engaged to the foot and extending from the first side flange to the second side flange, wherein the retention element is substantially curved and extends upwardly from the outer edge of the foot to an upper edge at a height on the first side flange and the second side flange, the retention element extends along an interior surface of the first side flange, an interior surface of the second side flange, and an interior surface of the flat flange and having a width greater than a width of the first side flange, second side flange, and flat flange and forming a cavity within;

an upper portion comprising a rim, wherein the flat flange, the first side flange, and the second side flange extend upwardly to the rim and the rim extends along a top side of an interior surface of the flat flange, the first side flange, and the second side flange; and two cavities that extend outwardly in the horizontal direction at a height above the rim; wherein the two cavities are for receiving an end of a longitudinal element and an end of a transverse element; and a lip extends in a horizontal plane between an upper exterior of the two cavities.

2. The stackable leg of claim 1, further comprising a bore that extends from a top side of the foot to a bottom side of the foot.

3. The stackable leg of claim 1, further comprising a bumper composed of rubber engaged to a bottom side of the foot.

4. The stackable leg of claim 1, wherein the stackable leg is composed of plastic.

5. The stackable leg of claim 1, wherein the cavity is generally square shaped.

6. The stackable leg of claim 1, wherein the flat flange, first side flange, and second side flange collectively form a reception recess.

7. A cot assembly, comprising:

two longitudinal elements each having two ends;

two transverse elements each having two ends;

four stackable legs, comprising:

a foot having an outer edge;

a flat flange extending generally upwardly from the foot;

a first side flange and a second side flange extending generally upwardly from the foot and flanking the flat flange, wherein the first side flange and second side flange are disposed at an angle compared to the flat flange;

a retention element engaged to the foot and extending from the first side flange to the second side flange, wherein the retention element is substantially curved and extends upwardly from the outer edge of the foot to an upper edge at a height on the first side flange and the second side flange, the retention element extends continuously along an interior surface of the first side flange, an interior surface of the second side flange, and an interior surface of the flat flange and having a width greater than the width of the first side flange, the second side flange, and the flat flange and forming a cavity within;

an upper portion comprising a rim, wherein the flat flange, the first side flange, and the second side flange extend upwardly to the rim and the rim extends along a top side of the interior surface of the flat flange, the first side flange, and the second side flange;

a first cavity that extends outwardly in the horizontal direction above the rim and a second cavity that extends outwardly in the horizontal direction above the rim, wherein the first cavity receives an end of the longitudinal element and the second cavity receives an end of the transverse element; and a lip that extend in a horizontal plane in an upper exterior between the cavities;

a sheet stretched across the longitudinal elements and transverse elements.

8. The cot assembly of claim 7, wherein the sheet has two longitudinal sides and two transverse sides, the sheet comprises a sheath on each longitudinal side and a sheath on each transverse side, whereby the sheaths on the longitudinal side receive the longitudinal elements and a sheath on the transverse side received the transverse elements.

9. The cot assembly of claim 7, wherein the two cavities extend substantially perpendicularly to each other in the horizontal plane.

10. The cot assembly of claim 7, wherein the flat flange, first side flange, and second side flange collectively form a reception recess.

11. The cot assembly of claim 7, wherein the longitudinal elements and transverse elements have a generally square cross-section and the cavities are generally square shaped.

* * * * *